US007264056B2

(12) United States Patent
Towler

(10) Patent No.: US 7,264,056 B2
(45) Date of Patent: Sep. 4, 2007

(54) SYSTEM AND METHOD FOR THE MITIGATION OF PARAFFIN WAX DEPOSITION FROM CRUDE OIL BY USING ULTRASONIC WAVES

(75) Inventor: Brian F. Towler, Laramie, WY (US)

(73) Assignee: University of Wyoming, Laramic, WY (US)

( * ) Notice: Subject to any disclaimer, the term of this patent is extended or adjusted under 35 U.S.C. 154(b) by 280 days.

(21) Appl. No.: 10/527,614

(22) PCT Filed: Sep. 12, 2003

(86) PCT No.: PCT/US03/28834

§ 371 (c)(1),
(2), (4) Date: Mar. 11, 2005

(87) PCT Pub. No.: WO2004/024309

PCT Pub. Date: Mar. 25, 2004

(65) Prior Publication Data

US 2005/0269097 A1 Dec. 8, 2005

Related U.S. Application Data

(60) Provisional application No. 60/410,472, filed on Sep. 13, 2002.

(51) Int. Cl.
*E21B 37/08* (2006.01)

(52) U.S. Cl. ..... 166/304; 166/177.2

(58) Field of Classification Search ..... 166/304, 166/65.1, 177.1, 177.2
See application file for complete search history.

(56) References Cited

U.S. PATENT DOCUMENTS 2,703,620 A * 3/1955 Truby ..... 166/60
2,705,460 A * 4/1955 Burdick ..... 417/313
4,958,683 A 9/1990 Alford et al.

* cited by examiner

*Primary Examiner*—William P Neuder
(74) *Attorney, Agent, or Firm*—Emery L. Tracy

(57) ABSTRACT

A method for mitigating the deposition of wax on production tubing walls. The method comprises positioning at least one ultrasonic frequency generating device adjacent the production tubing walls and producing at least one ultrasonic frequency thereby disintegrating the wax and inhibiting the wax from attaching to the production tubing walls. A system for mitigating the deposition of wax on production tubing walls is also provided.

20 Claims, 4 Drawing Sheets

Fig. 1 Typical Setup on Production String
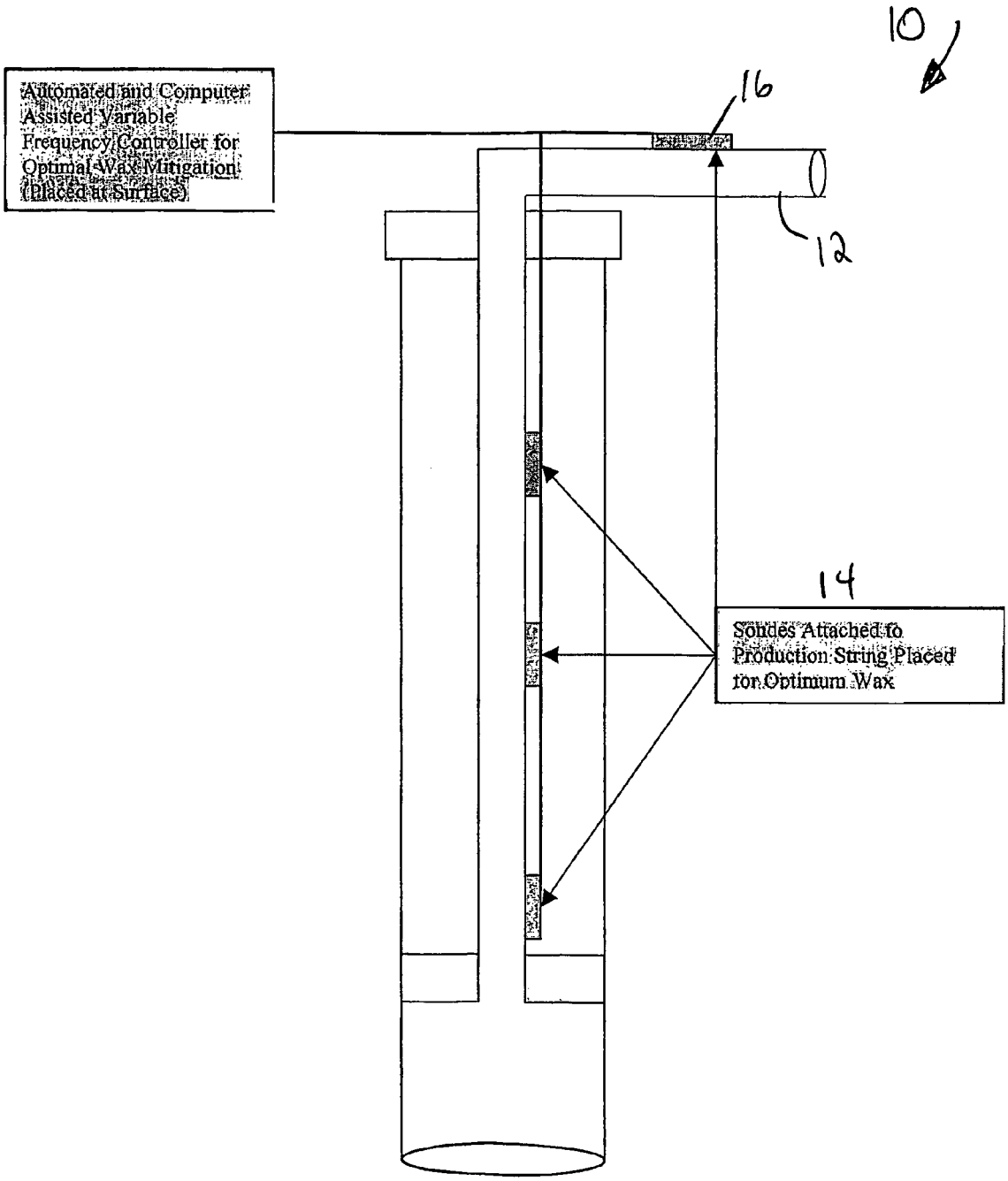

Fig. 2 Tube in the horizontal orientation
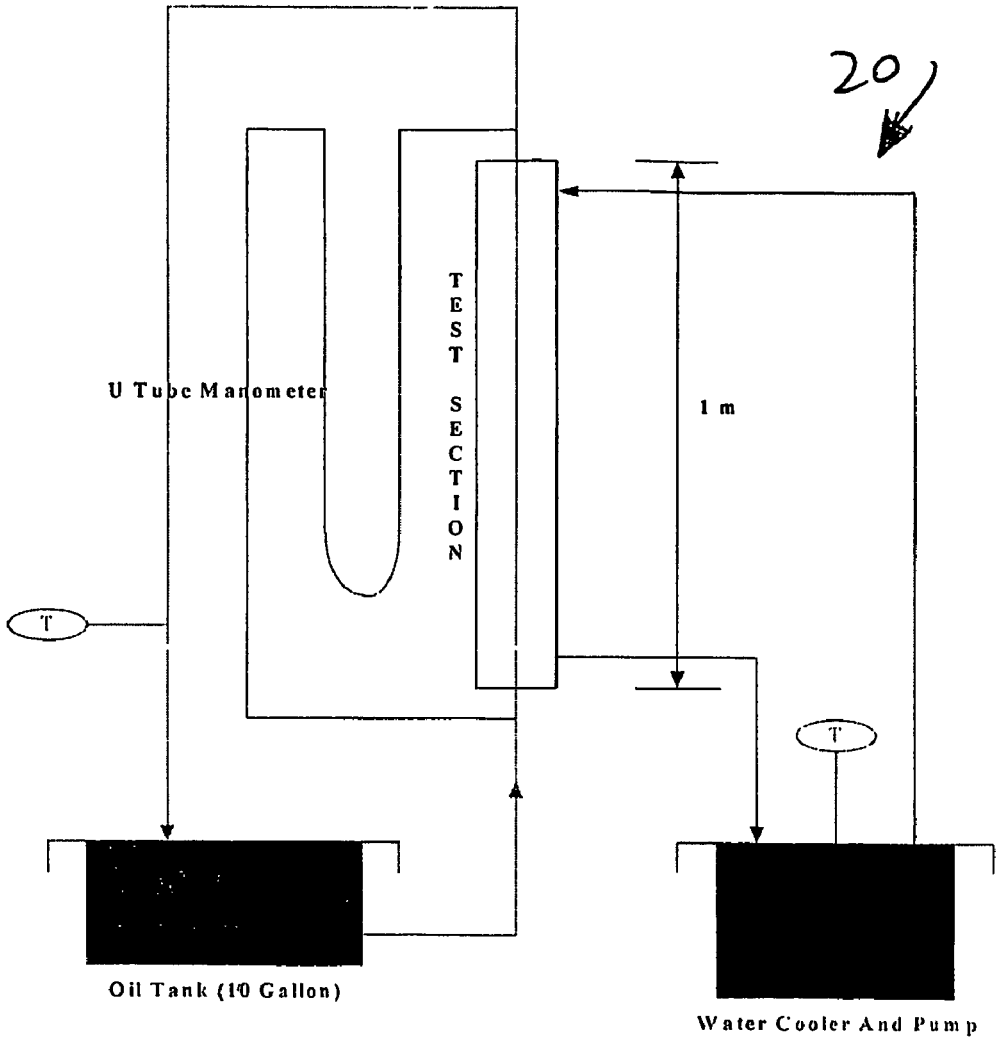

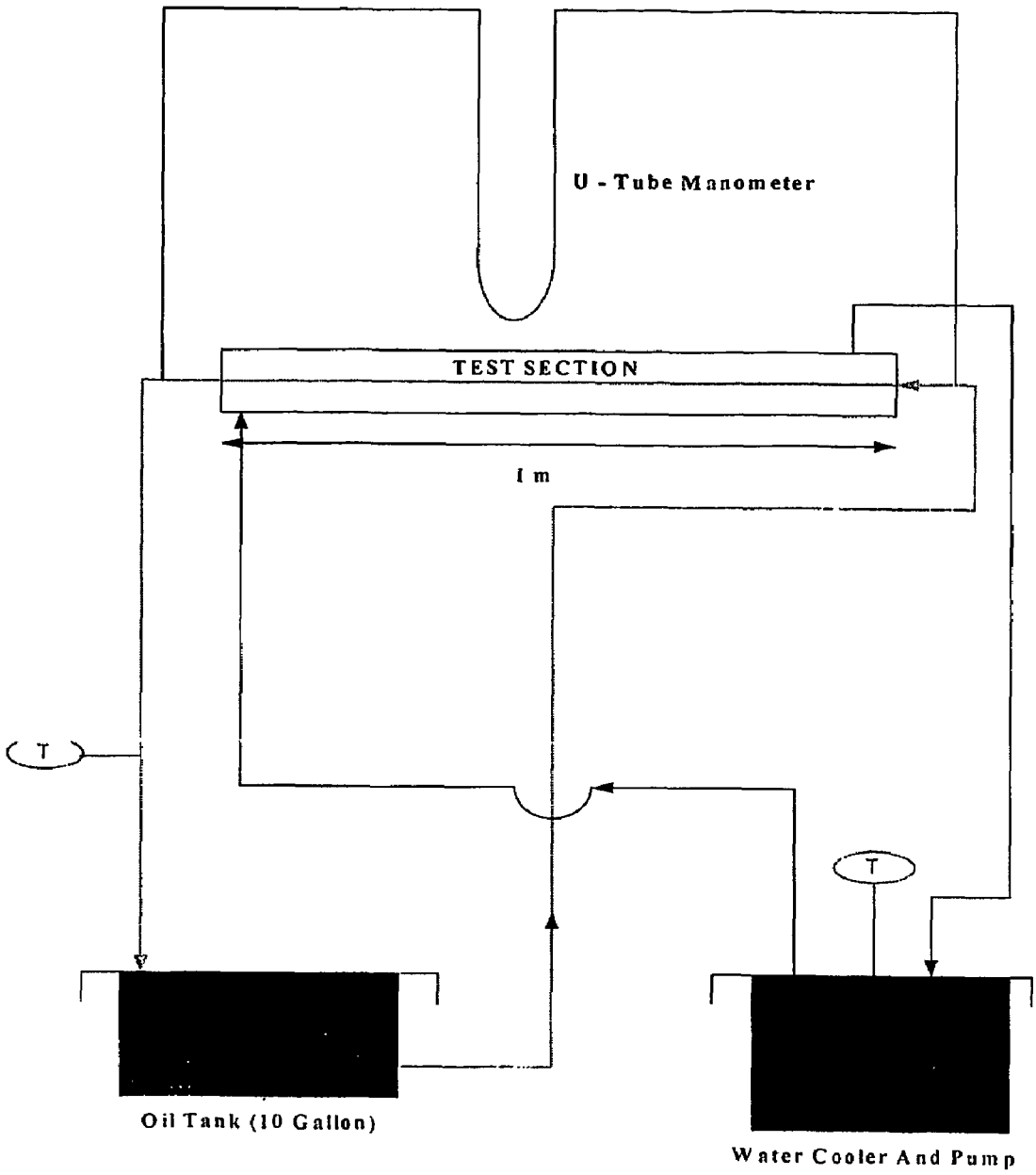
Fig. 3 Tube in the vertical orientation

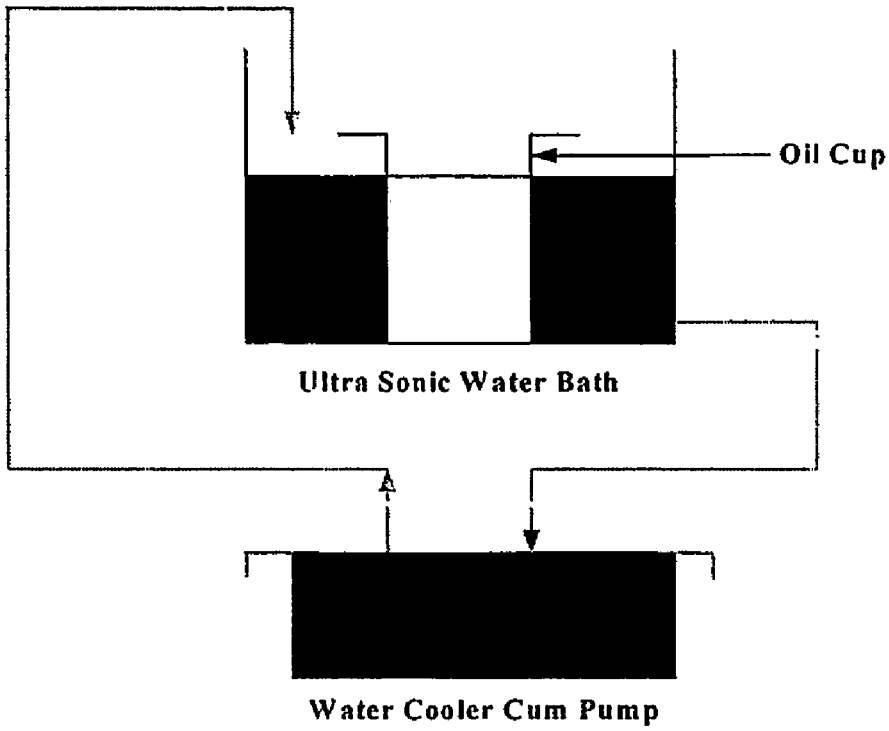
Fig. 4 Setup for the experiments using ultrasonic waves

SYSTEM AND METHOD FOR THE MITIGATION OF PARAFFIN WAX DEPOSITION FROM CRUDE OIL BY USING ULTRASONIC WAVES

CROSS REFERENCE TO RELATED APPLICATIONS

This application claims benefit of priority of PCT Patent Application No. PCT/US2003/028834, filed Sep. 12, 2003, and U.S. Provisional Application No. 60/410,472, filed Sep. 13, 2002.

The present application is a continuation of pending provisional patent application Ser. No. 60/410,472, filed on Sep. 13, 2002, entitled "System and Method for the Mitigation of Paraffin Wax Deposition From Crude Oil By Using Ultrasonic Waves".

CONTRACTUAL ORIGIN OF INVENTION

This invention was made with U.S. Government support under Contract No. DE-FC02-91ER75680 awarded by the U.S. Department of Energy. The U.S. Government has certain rights in this invention.

BACKGROUND OF THE INVENTION

1. Field of the Invention

This invention relates generally to system and method for the mitigation of paraffin was deposition from crude oil and, more particularly, the invention relates to a system and method for the mitigation of paraffin wax deposition from crude oil by using ultrasonic waves.

2. Description of the Prior Art

Wax deposition from crude oil is an enormously expensive problem for oil producers around the world. In the field, the production tubing is often plugged by paraffin wax which deposits on the walls of the production tubing and surface flow equipment. The deposition of the paraffin leads to a fall in the production rates of the oil from that well.

The deposition of the paraffin waxes from the reservoir fluid occurs when the temperature and pressure move below the cloud point of the fluid. The paraffin deposits start off as a thin film and slowly deposits in the form of crystalline solids, which collects on the interior of the tubing and flow-lines and slowly chokes off the production.

Basically, paraffin deposits are carbonaceous material, which is not soluble or dispersible by the crude oil under the prevailing conditions. Paraffins are composed primarily of alkanes with formulas $C_{18}H_{38}$ to $C_{70}H_{172}$. These are straight chained and branch chained compounds, and are generally inert and resistant to attack by acids, bases, and oxidizing agents. Previous research has shown that n-paraffins are more responsible for this problem. The formation of the deposit depends on the cloud point, an available surface and or loss of gas or light ends due to a drop in pressure. The precipitation is not uniform; it has peaks at certain points in the tubing and less deposition at other places.

The cloud point temperature is the key factor controlling the paraffin wax deposition. Paraffinic hydrocarbon liquids form a paraffin or wax solid phase when the temperature falls below the cloud point, or Wax Appearance Temperature (WAT), of the oil. As the oil flows up the well-bore, its pressure drops causing solution gas to liberate. This solution gas which is liberated acts to some degree as a solvent for waxes. Therefore, the loss of gas increases the cloud point temperature causing more precipitation and also makes the oil more viscous.

Also, as the oil moves upward, it cools since the ground temperature is less than the reservoir temperature. There is a temperature gradient at the wall and when the oil temperature reaches the cloud point the precipitation starts. This precipitation occurs even if the bulk oil temperature is more than the cloud point temperature, because it is the temperature of the oil at the wall, which plays the most important role in the precipitation of wax. The wax deposition problem is more prevalent in low flow rate wells because of the high residence time of oil in the well-bore. The increased flow time leads to more heat loss, which results in lowering of oil temperature and leads to wax precipitation and deposition. Well-bore studies have shown that the temperature profile in the well-bore is a strong function of the flow-rate. The paraffin wax problem is an example of fluid/solid equilibrium, which is described as a solution of higher molecular weight hydrocarbons in low molecular weight hydrocarbons which act as solvents.

SUMMARY

The present invention is a method for mitigating the deposition of wax on production tubing walls. The method comprises positioning at least one ultrasonic frequency generating device adjacent the production tubing walls and producing at least one ultrasonic frequency thereby disintegrating the wax and inhibiting the wax from attaching to the production tubing walls.

In addition, the present invention includes a system for mitigating the deposition of wax on production tubing walls. The system comprises at least one ultrasonic frequency generating device adjacent the production tubing walls and at least one ultrasonic frequency generated by the generating device thereby disintegrating the wax and inhibiting the wax from attaching to the production tubing walls.

BRIEF DESCRIPTION OF THE DRAWINGS

FIG. 1 is a schematic drawing illustrating the system and method for mitigation of paraffin wax deposition from crude oil using ultrasonic waves, constructed in accordance with the present invention;

FIG. 2 is a schematic drawing illustrating the system and method for mitigation of paraffin wax deposition from crude oil using ultrasonic waves, constructed in accordance with the present invention, with the tube in the horizontal orientation;

FIG. 3 is a schematic drawing illustrating the system and method for mitigation of paraffin wax deposition from crude oil using ultrasonic waves, constructed in accordance with the present invention, with the tube in the vertical orientation; and FIG. 4 is a schematic drawing illustrating an experimental setup of the system and method for mitigation of paraffin wax deposition from crude oil using ultrasonic waves, constructed in accordance with the present invention, with an ultrasonic water bath connected to a water cooler pump combination used to circulate water at a fixed temperature.

DETAILED DESCRIPTION OF THE PREFERRED EMBODIMENTS

As illustrated in FIG. 1, the present invention is a system and method, indicated generally at 10, for mitigating the deposition of wax on production tubing 12 accumulated from crude oil during production by the use of ultrasonic waves. The system and method of the present invention uses ultrasonic waves to disintegrate the wax and inhibit the wax from attaching to the walls.

The ultrasonic waves or frequencies are generated by at least one device or sonde 14 attached to the outside of the production tubing 12 at strategic locations along its length. While three particular frequencies have been identified as the optimal frequencies of operation, these are only a guide for selection of the desirable frequencies of operation. In a preferred embodiment, the high frequency is approximately five hundred (500) KHz and the low frequency is about ten (10) KHz.

The first frequency is the characteristic frequency of the production tubing, designated optimal frequency one (OF1). Using the first frequency, the ultrasonic waves set the production tubing 12 vibrating thereby inhibiting the wax from depositing on the wall. The second frequency (optimal frequency two (OF2)) is the frequency that breaks the wax up into smaller particles by breaking the bonds which cause the wax molecules to adhere together. The third frequency (optimal frequency three (OF3)) actually breaks the bonds of the wax molecules so that the long chained alkanes are broken down into smaller molecules. These smaller molecules will be more soluble in the oil and so will not precipitate out as wax. Consequently the ultrasonic wave generator 14 will be broadcasting at all or any of the three frequencies depending on which of the frequencies are not having the desired effect.

In practice, however, these three frequencies would only be a guide for selection of the desirable frequencies of operation. The present invention includes a variable frequency device 16 for determining the optimal frequencies in the range around the three theoretical optimal frequencies. The ultrasonic broadcast device 14 generates all three frequencies, once they have been identified by the variable frequency device 16.

The three frequencies would have three separate effects. As briefly described above, the OF1 sets the production tubing walls 12 vibrating and hence, inhibits wax molecules from depositing on the walls. Instead, the wax molecules remain entrained in the flowing oil and are carried away. The OF2 inhibits the precipitated wax molecules from adhering together and from adhering to the walls. The OF3 breaks the unprecipitated long chain wax molecules into smaller molecules and makes the wax molecules more soluble in the oil thereby lowering the cloud point temperature and allowing the molecules to remain in solution. The combination of these three effects greatly reduces the wax deposition so that it is more manageable and removal is required far less frequently.

As illustrated in FIGS. 2 and 3, a paraffin deposition flow system 20 has been constructed to simulate the deposition of paraffin in the wells. The flow system 20 consists of two concentric tubes with a facility to measure the pressure drop between the ends of the inner tube, called the test section. The crude oil used to conduct the experiments is stored in a reservoir having a capacity of ten gallons. The crude can be pumped into the test section and back into the reservoir. The flow rate is adjusted using a flow meter and a bypass valve. An inclined manometer is used to measure the pressure drop across the section. The pressure drop is used to determine the pipe diameter and hence the thickness of the wax deposition. The manometer was inclined at an angle of thirty-five (35°) degrees to the horizontal and the manometric fluid is water. A facility to monitor the temperature in the test section and in the reservoir is also provided. A blower was required to keep the pump from over heating as the experiments are run for long periods. A water bath attached to a refrigeration unit is used to provide cooling for the walls of the inner tube.

Water is pumped into the outer annulus and then back into the water bath maintaining the walls of the test section at the required temperature throughout the experiment. At the start of each experiment, the manometer is checked to ensure zero reading and the flow rate adjusted using pump speed and a bypass valve. Manometer readings are noted at regular intervals until the end of the experiment. At the end of experiment, all the pumps and coolers are switched off and test section is dissembled. Paraffin that is deposited in the test section is removed using scrapers and the amount of paraffin measured using a measuring jar. The ultrasonic frequency generating equipment is attached to the outside of the tube carrying the flowing oil.

The static experimental setup to study the effect of ultrasonic waves on wax deposition is shown in FIG. 4. It consists of an ultrasonic water bath that was connected to a water cooler pump combination that was used to circulate the water at some fixed temperature throughout the duration of the experiment.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A method for mitigating the deposition of wax on production tubing walls within a bore hole, the method comprising:

positioning at least one ultrasonic frequency generating device adjacent the production tubing walls;

positioning a variable frequency device outside the bore hole; and producing at least one ultrasonic frequency thereby disintegrating the wax and inhibiting the wax from attaching to the production tubing walls.

2. The method of claim 1 and further comprising:

producing three predetermined frequencies, the frequencies being a first frequency, a second frequency, and a third frequency.

3. The method of claim 2 wherein the three frequencies range between approximately ten (10) KHz and approximately two thousand (2000) KHz.

4. The method of claim 2 and further comprising:

producing the first frequency;

vibrating the production tubing; and inhibiting the wax from depositing on the production tubing walls.

5. The method of claim 2 and further comprising:

producing the second frequency; and breaking the bonds adhering the wax molecules together thereby disintegrating the wax into particles.

6. The method of claim 2 and further comprising:

producing the third frequency;

reducing the long chained alkanes of the wax molecules thereby reducing the wax into smaller molecules.

7. The method of claim 2 and further comprising:

generating all three predetermined frequencies simultaneously.

8. The method of claim 1 and further comprising:

determining the optimal frequencies with the variable frequency device.

9. A system for mitigating the deposition of wax on production tubing walls within a bore hole, the system comprising:

at least one ultrasonic frequency generating device adjacent the production tubing walls;

a variable frequency device positioned outside the bore hole; and at least one ultrasonic frequency generated by the generating device thereby disintegrating the wax and inhibiting the wax from attaching to the production tubing walls.

10. The system of claim 9 wherein three predetermined frequencies are generated.

11. The system of claim 10 wherein the three frequencies range between approximately ten (10) KHz and approximately two thousand (2000) KHz.

12. The system of claim 10 wherein the first frequency is approximately equal to the characteristic frequency of the production tubing thereby vibrating the production tubing and inhibiting the wax from depositing on the production tubing walls.

13. The system of claim 10 wherein the second frequency has a frequency sufficient to disintegrate the wax into particles by breaking the bonds which cause the wax molecules to adhere together.

14. The system of claim 10 wherein the third frequency has a frequency sufficient to break the bonds of the wax molecules so that the long chained alkanes are broken down into smaller molecules.

15. The system of claim 10 and further comprising:

generating all three predetermined frequencies simultaneously.

16. The system of claim 9 and further comprising: the variable frequency device determining the optimum frequencies.

17. A method for mitigating the deposition of wax on production tubing walls, the method comprising:

positioning at least one ultrasonic frequency generating device adjacent the production tubing walls;

producing at least one ultrasonic frequency thereby disintegrating the wax and inhibiting the wax from attaching to the production tubing walls; and determining the optimal frequencies with a variable frequency device.

18. The method of claim 17 and further comprising:

producing three predetermined frequencies, the frequencies being a first frequency, a second frequency, and a third frequency.

19. A system for mitigating the deposition of wax on production tubing walls, the system comprising:

at least one ultrasonic frequency generating device adjacent the production tubing walls;

at least one ultrasonic frequency generated by the generating device thereby disintegrating the wax and inhibiting the wax from attaching to the production tubing walls; and a variable frequency device for determining the optimum frequencies.

20. The system of claim 19 wherein three predetermined frequencies are generated.

* * * * *